US005451496A

United States Patent [19]

Merkel et al.

[11] Patent Number: 5,451,496

[45] Date of Patent: Sep. 19, 1995

[54] COLOR PHOTOGRAPHIC MATERIALS AND METHODS CONTAINING DIR OR DIAR COUPLERS AND PHENOLIC COUPLER SOLVENTS

[75] Inventors: Paul B. Merkel, Rochester; Melvin M. Kestner, Hilton; Paul L. Zengerle, Rochester, all of N.Y.

[73] Assignee: Eastman Kodak Company, Rochester, N.Y.

[21] Appl. No.: 218,855

[22] Filed: Mar. 28, 1994

Related U.S. Application Data

[63] Continuation of Ser. No. 887,728, May 22, 1992, abandoned.

[51] Int. Cl.[6] ..... G03C 7/305; G03C 7/388

[52] U.S. Cl. ..... 430/544; 430/546; 430/552; 430/553; 430/957

[58] Field of Search ..... 430/546, 544, 552, 553, 430/957

[56] References Cited

U.S. PATENT DOCUMENTS

| | | | |
|---|---|---|---|
| 2,835,579 | 5/1958 | Thirtle et al. | 430/546 |
| 3,227,554 | 4/1963 | Barr et al. | 430/382 |
| 4,248,962 | 2/1981 | Lau | 430/382 |
| 4,551,422 | 11/1985 | Kimura et al. | 430/551 |
| 4,774,166 | 9/1988 | Sasaki et al. | 430/376 |
| 5,021,555 | 6/1991 | Szajewski et al. | 438/544 |

FOREIGN PATENT DOCUMENTS

| | | | |
|---|---|---|---|
| 2247364 | 10/1987 | Japan | 430/546 |
| 3296045 | 12/1988 | Japan | 430/546 |

*Primary Examiner*—Lee C. Wright
*Attorney, Agent, or Firm*—Gordon M. Stewart

[57] ABSTRACT

Color photographic materials comprise a substrate bearing a silver halide emulsion and a coupler composition comprising (a) a 2-phenylcarbamoyl-1-naphthol compound selected from the group consisting of development inhibitor releasing couplers and timed development inhibiting releasing couplers, and (b) a phenolic coupler solvent. The phenolic coupler solvent is employed to reduce dye density changes and/or dye hue changes resulting from cold storage of the photographic materials.

21 Claims, 1 Drawing Sheet

COLOR PHOTOGRAPHIC MATERIALS AND METHODS CONTAINING DIR OR DIAR COUPLERS AND PHENOLIC COUPLER SOLVENTS

This application is a continuation of application Ser. No. 07/887,728 filed May 22, 1992, now abandoned.

FIELD OF THE INVENTION

The present invention relates to color photographic materials containing 2-phenylcarbamoyl-1-naphthol development inhibitor releasing (DIR) couplers and/or 2-phenylcarbamoyl-1-naphthol timed development inhibiting releasing (DIAR) couplers in combination with phenolic coupler solvents. The present invention further relates to methods for reducing dye density changes and/or dye hue changes resulting from cold storage of color photographic materials comprising a 2-phenylcarbamoyl-1-naphthol DIR and/or DIAR coupler.

BACKGROUND OF THE INVENTION

Color photographic materials containing one or more image-modifying couplers are well-known in the art. Image-modifying couplers may release development inhibitors when they react with oxidized developer. The inhibitors interact with silver halide to provide one or more functions such as gamma or curve shape control, sharpness enhancement, granularity reduction and color correction via interlayer-interimage effects. The image-modifying couplers include development inhibitor releasing couplers (DIR couplers) from which inhibitor is released directly as a coupling-off group. DIR couplers are disclosed, for example in U.S. Pat. No. 3,227,554. The image-modifying couplers also include timed development inhibiting releasing couplers (DIAR couplers) from which inhibitor is released as a coupling-off group after a time delay. The time delay results from an additional chemical reaction step involving a timing group included in the DIAR coupler. DIAR couplers are disclosed, for example, in U.S. Pat. No, 4,248,962.

The Szajewski et al U.S. Pat. No. 5,021,555 discloses DIR and DIAR couplers derived from 2-phenylcarbamoyl-1-naphthol compounds for use in color photographic materials, particularly color negative films. The 2-phenylcarbamoyl-1-naphthol compounds are particularly advantageous in their ease of synthesis, low cost, high activity, good dye hues and resistance to leuco dye formation in seasoned bleaches.

However, one disadvantage associated with DIR and DIAR couplers derived from 2-phenylcarbamoyl-1-naphthol compounds is that upon exposure to low temperatures, i.e., for example on storage in a freezer, changes in hue and density may occur. These changes arise from crystallization of the dyes produced by oxidative coupling of the 2-phenylcarbamoyl-1-naphthol compounds with color developer. The hue and density changes may cause inaccurate color and tone reproduction when the color negative films which have been stored at low temperatures are later printed.

Accordingly, a need exists for color photographic materials which contain DIR and/or DIAR coupler 2-phenylcarbamoyl-1-naphthol compounds and which resist hue and density changes when stored at low temperatures. The Thirtle U.S. Pat. No. 2,835,579 discloses alkylphenol and acylphenol coupler solvents in combination with various dye-forming couplers. The Kimura et al U.S. Pat. No. 4,551,422 discloses silver halide photographic light-sensitive materials comprising at least one phenol cyan coupler, such as a 2-phenylureido-5-carbonamido-phenol coupler, in combination with a non-color-developable and diffusion resistive phenol compound. The Sasaki et al U.S. Pat. No. 4,774,166 discloses the use of numerous couplers, solvents and addenda, including, among others, phenols, in combination with various couplers for coloration acceleration.

SUMMARY OF THE INVENTION

Accordingly, it is an object of the present invention to provide color photographic materials which overcome the above-noted disadvantage of the prior art. It is a related object of the invention to provide color photographic materials containing a 2-phenylcarbamoyl-1-naphthol compound which is a DIR coupler or DIAR coupler. It is a further object of the invention to provide such color photographic materials, particularly color negative films, which resist changes in dye hue and/or dye density resulting from crystallization during cold storage of the materials. It is a further object of the invention to provide inexpensive color negative films which yield good color reproduction and good sharpness characteristics. It is an additional object of the invention to provide methods for reducing dye density changes and/or dye hue changes resulting from cold storage of a color photographic material, particularly color negative films, which contain a 2-phenylcarbamoyl-1-naphthol DIR coupler and/or DIAR coupler.

These and additional objects are provided by the color photographic materials and methods of the present invention. The color photographic materials comprise a substrate bearing a silver halide emulsion and a coupler composition. The coupler composition comprises at least one of a 2-phenylcarbamoyl-1-naphthol DIR coupler and a 2-phenylcarbamoyl-1-naphthol DIAR coupler, and a phenolic coupler solvent. The present inventors have surprisingly discovered that use of the phenolic coupler solvent in combination with the 2-phenylcarbamoyl-1-naphthol DIR or DIAR coupler minimizes or eliminates the undesirable hue changes and density changes resulting from cold storage of color photographic materials containing the couplers. In accordance with the methods of the invention, dye density changes and/or dye hue changes resulting from cold storage of a color photographic material comprising a 2-phenylcarbamoyl-1-naphthol DIR coupler or DIAR coupler are reduced by providing a phenolic coupler solvent in combination with the 2-phenylcarbamoyl-1-naphthol DIR or DIAR coupler.

These and additional objects and advantages will be more fully apparent in view of the following detailed description.

BRIEF DESCRIPTION OF THE DRAWING

The drawing sets forth in FIGS. 1A and 1B the absorption spectra of multilayer films according to the prior art and according to the invention, respectively, as described in Example 4.

DETAILED DESCRIPTION

Figure 1A:
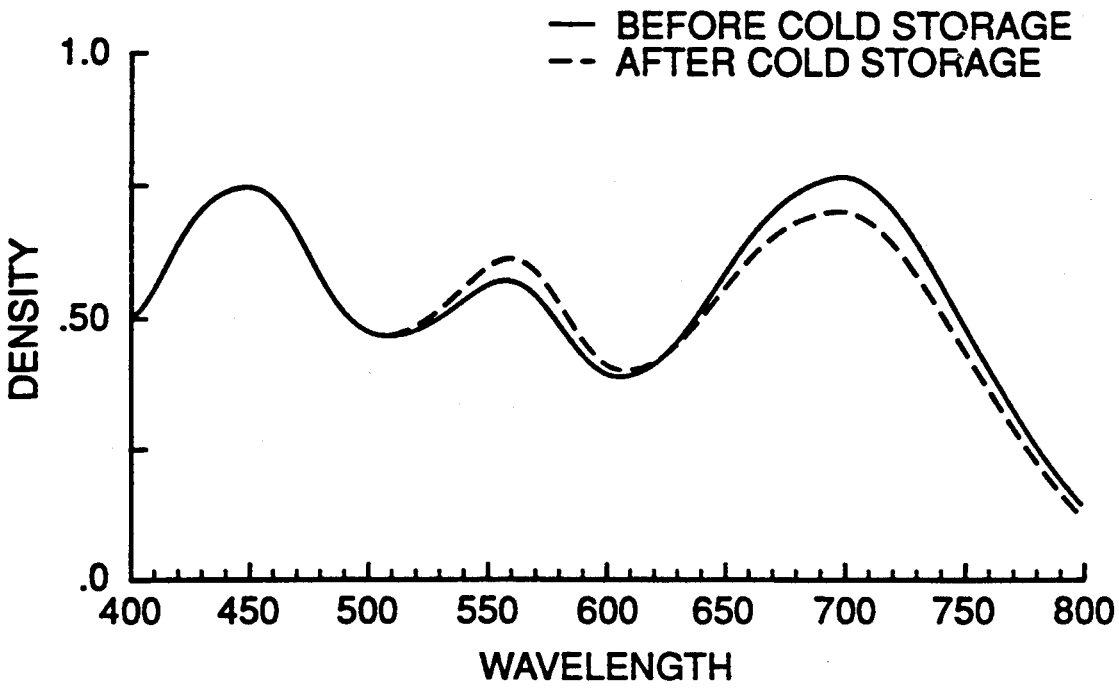

The color photographic materials of the present invention comprise a substrate bearing a silver halide emulsion and a coupler composition. The coupler composition comprises a 2-phenylcarbamoyl-1-naphthol development inhibitor releasing (DIR) coupler and/or a timed development inhibiting releasing (DIAR) coupler, and a phenolic coupler solvent.

The 2-phenylcarbamoyl-1-naphthol DIR couplers and DIAR couplers are known in the art, as are the methods of their preparation, and are disclosed, for example, in the Szajewski et al U.S. Pat. No. 5,021,555 which is incorporated herein by reference. Preferably, the 2-phenylcarbamoyl-1-naphthol DIR couplers for use in the present invention are of the following formula I:

FORMULA I

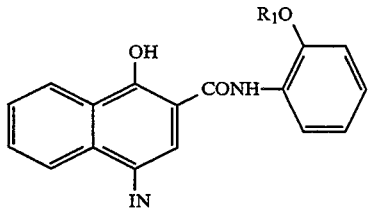

wherein $R_1$ is selected from the group consisting of unsubstituted straight chain alkyl groups containing from about 8 to about 20 carbon atoms and substituted alkyl groups containing from about 10 to about 30 carbon atoms, the substituents being selected from the group consisting of phenyl, alkoxy, aryloxy and alkoxycarbonyl groups; and IN is an inhibitor moiety.

Suitable 2-phenylcarbamoyl-1-naphthol DIAR couplers for use in the present color photographic materials are of the following formulas II or III:

FORMULA II

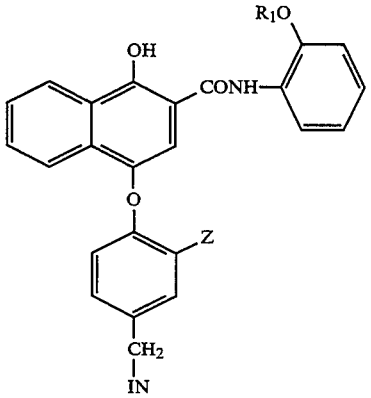

FORMULA III

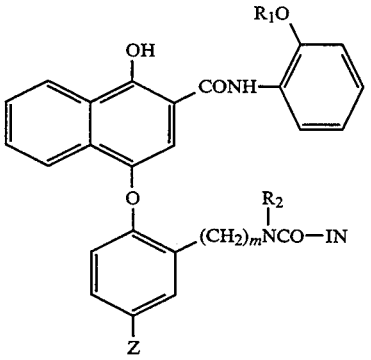

wherein $R_1$ is as defined above, $R_2$ is selected from the group consisting of straight and branched chain alkyl groups containing from 1 to about 8 carbon atoms, unsubstituted phenyl, and phenyl substituted with at least one group selected from the group consisting of alkyl and alkoxy groups; Z is part of a timing group and is selected from the group consisting of nitro, cyano, alkylsulfonyl, sulfamoyl and sulfonamido groups; IN is an inhibitor moiety; and m is 0 or 1.

In the 2-phenylcarbamoyl-1-naphthol DIR and DIAR couplers defined by formulas I–III set forth above, preferred $R_1$ groups comprise unsubstituted straight chain alkyl groups, particularly in view of the relatively easy synthesis of such couplers. In a particularly preferred embodiment of the invention, $R_1$ comprises a tetradecyl group.

In the DIR and DIAR coupler formulas I–III set forth above, the inhibiter moiety IN is a group well known in the color photographic art as disclosed in the aforementioned Szajewski et al U.S. Pat. No. 5,021,555 which is incorporated herein by reference. In a preferred embodiment, the inhibitor moiety is selected from the following formulas IV–VIII:

FORMULA IV

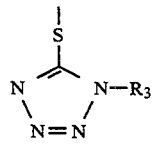

FORMULA V

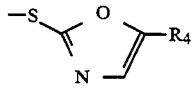

FORMULA VI

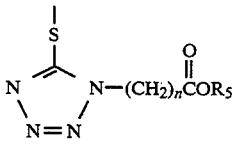

FORMULA VII

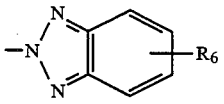

FORMULA VIII

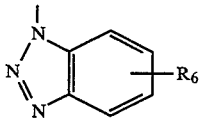

wherein $R_3$ is selected from the group consisting of unsubstituted straight and branched chain alkyl groups containing from 1 to about 8 carbon atoms, an unsubstituted benzyl group, an unsubstituted phenyl group, and said groups containing at least one alkoxy substituent; $R_4$ is selected from the group consisting of $R_3$ and —S—$R_3$; $R_5$ is selected from the group consisting of straight and branched chain alkyl groups containing from 1 to about 5 carbon atoms; $R_6$ is selected from the group consisting of hydrogen, halogen, alkoxy, phenyl, —$COOR_7$ and $NHCOOR_7$, wherein $R_7$ is selected from the group consisting of alkyl and phenyl groups; and n is from 1 to 3. In preferred embodiments of the DIR couplers and the DIAR couplers of the present invention, the inhibiter moiety IN is of the formula IV. In further preferred embodiments of the DIR couplers, the inhibitor moiety IN is of the formula IV and $R_3$ is an ethyl or phenyl group. In a further preferred embodiment, the DIAR coupler is of formula II, Z is a nitro group, the inhibitor moiety IN is of the formula IV and $R_3$ is a p-methoxybenzyl group or a phenyl group.

Specific examples of 2-phenylcarbamoyl-1-naphthol DIR couplers suitable for use in the color photographic materials and methods of the invention include, but are not limited to, the following couplers C1–C3:

C1

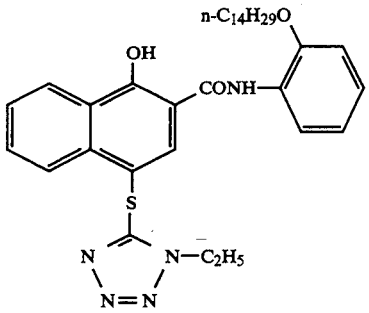

C2

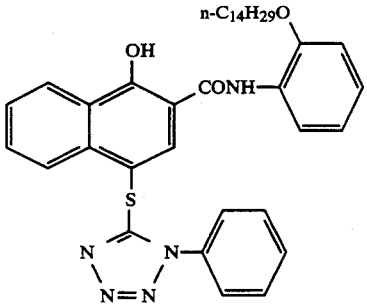

C3

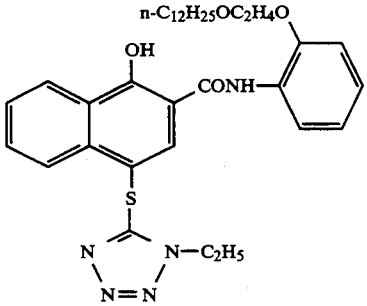

Examples of 2-phenylcarbamoyl-1-naphthol DIAR couplers suitable for use in the color photographic materials and methods of the present invention include, but are not limited to, the following couplers C4–C8:

C4

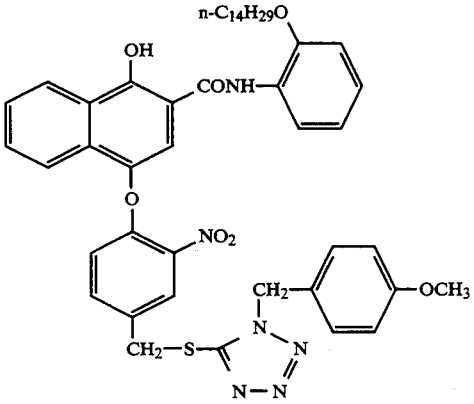

-continued

C5

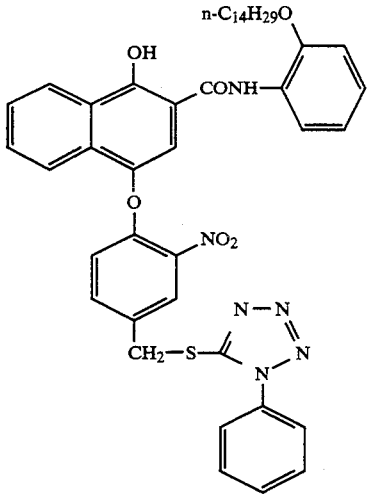

C6

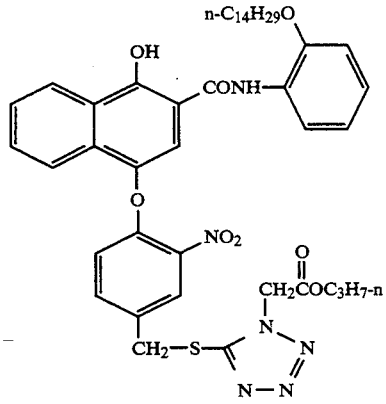

C7

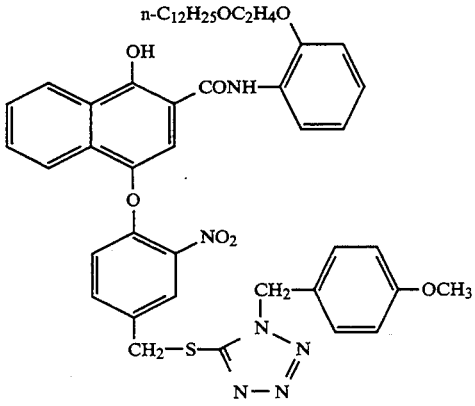

-continued

C8

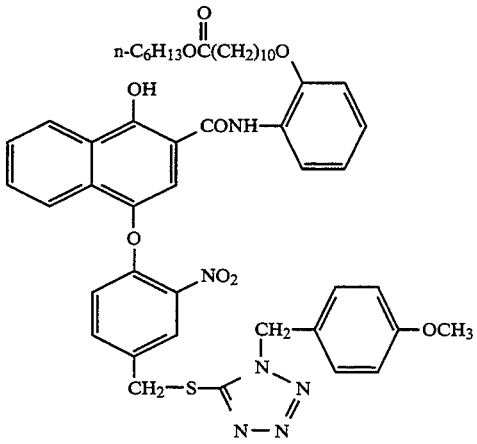

As noted above, the 2-phenylcarbamoyl-1-naphthol DIR couplers and DIAR couplers, particularly those including the $R_1$ group as defined above, have been found to yield dyes which crystallize and change color hue and/or color density as a result of storage at relatively cold temperatures, i.e. temperatures less than about 0° C. These hue and density changes may cause inaccurate color and tone reproduction when color film negatives which have been stored at low temperatures are printed. The present inventors have discovered that when the 2-phenylcarbamoyl-1-naphthol DIR couplers and DIAR couplers are used in combination with a phenolic coupler solvent, crystallization is avoided and changes in the color dye hue and/or color dye density are minimized or eliminated.

In a preferred embodiment, the phenolic coupler solvent is of the following formula IX:

FORMULA IX

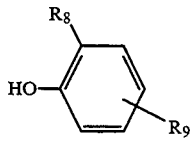

wherein $R_8$ and $R_9$ are individually selected from the group consisting of hydrogen and straight and branched chain alkyl groups, with the provision that at least one of $R_8$ and $R_9$ is not hydrogen, the total number of carbon atoms in $R_8$ and $R_9$ is at least about 9, and $R_9$ is in a para or meta position with respect to the phenolic hydroxyl group. Preferably, the total number of carbon atoms in $R_8$ and $R_9$ is from 9 to about 20 in order to minimize the volatility, water solubility and diffusivity of the phenolic compound. Additionally, it is preferred that the phenolic coupler solvent included in combination with the 1-phenylcarbamoyl-1-naphthol DIR or DIAR coupler is liquid at room temperature. In preferred embodiments of the phenolic coupler solvent of formula IX, $R_8$ is hydrogen and $R_9$ is in the para position with respect to the phenolic hydroxyl group. As will be demonstrated in the examples set forth below, a preferred phenolic coupler solvent comprises p-dodecylphenol wherein in the dodecyl group may comprise a mixture of isomers.

Examples of phenolic coupler solvents suitable for use in the color photographic materials and methods of the present invention include, but are not limited to, the following phenolic compounds P1–P6:

P1

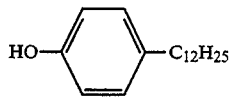

mixed isomers

P2

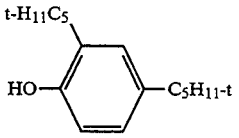

P3

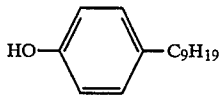

mixed isomers

P4

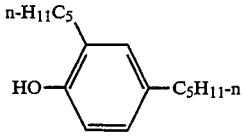

P5

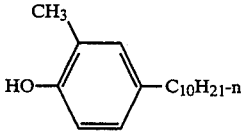

P6

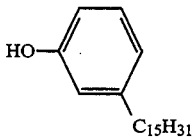

The 2-phenylcarbamoyl-1-naphthol DIR and/or DIAR coupler and the phenolic coupler solvent are codispersed and incorporated in the color photographic materials of the invention. The phenolic coupler solvent is included in an amount sufficient to reduce dye density changes and/or dye hue changes resulting from cold storage of the color photographic materials. Preferably, the 2-phenylcarbamoyl-1-naphthol DIR and/or DIAR coupler and the phenolic coupler solvent are combined in a weight ratio of from about 1:0.2 to about 1:5, and more preferably in a weight ratio of from about 1:0.5 to about 1:4.

The phenolic coupler solvents act as water-immiscible solvents for the 2-phenylcarbamoyl-1-naphthol DIR and DIAR couplers and for dyes generated from these couplers as a result of the coupling reaction with oxidized developer during photographic development. One or more additional high-boiling water-immiscible organic compounds may be employed together with the phenolic coupler solvent as a cosolvent, if desired. High-boiling water-immiscible organic coupler solvents are known in the art, and such solvents which are particularly suitable for use as cosolvents in the present invention include, but are not limited to, aryl phosphates, e.g., tritolyl phosphate, alkyl phosphates, for example trioctyl phosphate, mixed aryl alkyl phosphates, esters of aromatic acids, for example, dibutyl phthalate, esters of aliphatic acids, for example, dibutyl sebecate, alcohols, for example 2-hexyl-1-decanol, sulfonamides, for example, N,N-dibutyl-p-toluenesulfonamide, and hydroxybenzoates, for example 2-ethylhexylp-hydroxybenzoate. A preferred cosolvent comprises dibutyl phthalate. In a preferred embodiment wherein a cosolvent is employed together with the phenolic coupler solvent, it is preferred that the weight ratio of the phenolic coupler solvent to the cosolvent is in the range from about 1:0.2 to 1:4.

As noted above, the 2-phenylcarbamoyl-1-naphthol DIR and/or DIAR couplers and the phenolic coupler solvent are codispersed in the color photographic materials and methods of the invention. Preferably, the couplers are dissolved in the phenolic coupler solvent and any cosolvent which may be employed, and the resulting mixture is then dispersed as small particles in aqueous solutions of gelatin and surfactant in manners well known in the art, for example, by milling or homogenization. In accordance with additional techniques well known in the art, removable auxiliary organic solvents, for example, ethyl acetate or cyclohexanone, may also be employed in the preparation of such dispersions to facilitate the dissolution of the DIR and/or DIAR couplers in the organic phase.

In the materials and methods of the present invention, the coupler compositions containing the DIR coupler and/or the DIAR coupler and the phenolic coupler solvent are coated, together with a silver halide emulsion, on a substrate. The coupler compositions may further include one or more additional imaging couplers known in the art if desired. In a preferred embodiment, the coupler compositions include at least one imaging coupler comprising a 2-phenylureido-5-carbonamidophenol. Such imaging couplers are well known in the art and are disclosed, for example, in the Szajewski et al U.S. Pat. No. 5,021,555 discussed above. Preferably, the 2-phenylureido-5-carbonamidophenol imaging coupler is of the following formula X:

FORMULA X

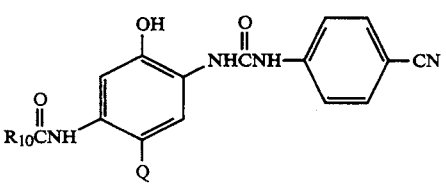

wherein $R_{10}$ is a ballast group containing from about 12 to about 25 carbon atoms; and Q is selected from the group consisting of hydrogen, an unsubstituted phenoxy coupling-off group, and substituted phenoxy coupling-Off groups wherein the phenoxy moiety is substituted with one or more substituents selected from the group consisting of alkyl groups of from 1 to about 8 carbon atoms, for example a 4-isopropyl group, and alkoxy groups of from 1 to about 8 carbon atoms, for example a 4-methoxy group. Ballast groups suitable for use as substituent $R_{10}$ are well known in the art to minimize the volatility, water solubility and diffusivity of such imaging couplers. In a preferred embodiment, $R_{10}$ includes one or more groups selected from unsubstituted straight and branched chain alkyl groups, unsubstituted straight and branched chain alkenyl groups and unsubstituted straight and branched chain alkylene groups; substituted straight and branched chain alkyl groups, substituted straight and branched chain alkenyl groups, substituted straight and branched chain alkylene groups, and substituted phenyl groups wherein the substituent is at least one member selected from the group consisting of aryl, alkoxy, aryloxy, alkoxycarbonyl, aryloxycarbonyl, acyloxy, carbonamido, carbamoyl, sulfonyl and sulfoxyl groups.

Examples of 2-phenylureido-5-carbonamidophenol imaging couplers suitable for use in the coupler compositions of the color photographic materials and methods of the present invention include, but are not limited to, the following couplers A1–A4:

A1

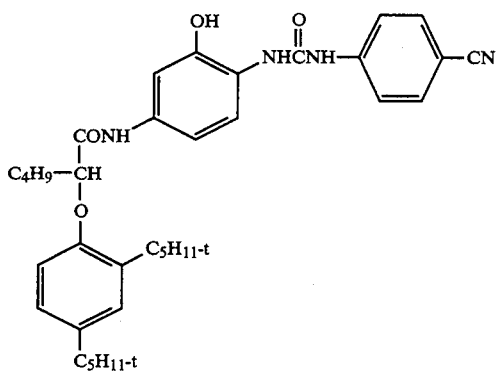

A2

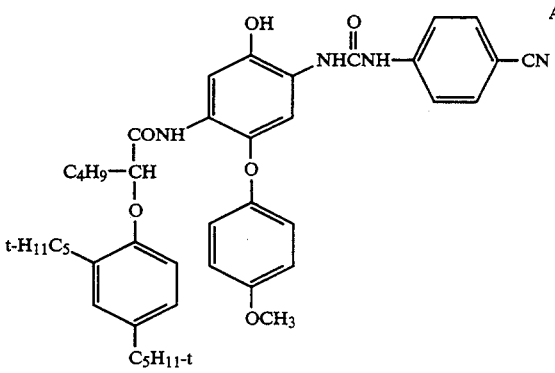

A3

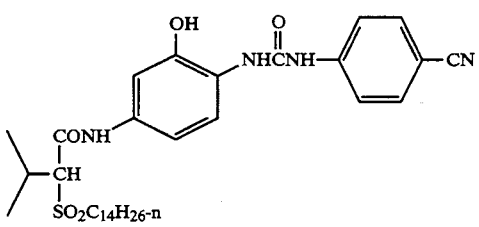

A4

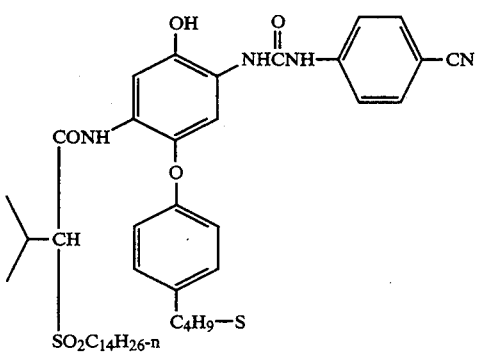

The 2-phenylureido-5-carbonamidophenol imaging coupler may be codispersed with the 2-phenylcarbamoyl-1-naphthol DIR and/or DIAR coupler and the phenolic coupler solvent and incorporated into the color photographic materials of the invention. Alternatively, the 2-phenylureido-5-carbonamidophenol imaging coupler may be incorporated into the color photographic material as a separate dispersion. The coupler dispersions and a silver halide emulsion are coated on a supporting substrate in accordance with methods well known in the color photographic art. The color photographic materials of the present invention are imagewise exposed and developed in a solution containing a primary aromatic amine color developing agent. As also known in the art, the developing agent is oxidized in an imagewise manner by reaction with exposed silver halide grains, and the oxidized developer reacts with coupler to form dye. The DIR and DIAR couplers included in the materials of the present invention release inhibitor in the process of dye formation, and the inhibitor interacts with the silver halide to produce the aforementioned photographic effects.

The photographic materials of the present invention may be simple elements or multilayer, multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The element typically will have a total thickness (excluding the support) of from 5 to 30 microns.

In the following discussion of suitable materials for use in the elements of this invention, reference will be made to *Research Disclosure*, December 1978, Item 17643, and December 1989, Item No. 308119 published by Kenneth Mason Publications, Ltd., Dudley Annex, 12a North Street, Emsworth, Hampshire PO10 7DQ, ENGLAND, the disclosures of which are incorporated herein by reference. This publication will be identified hereafter by the term "Research Disclosure." The elements of the invention can comprise emulsions and addenda described in this publication and publications referenced in this publication.

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos., 4,672,027 and 4,693,964, all of which are incorporated herein by reference. Also specifically contemplated are those silver bromoiodide grains with a higher molar proportion of iodide in the core of the grain than in the periphery of the grain, such as those described in British Reference No. 1,027,146; Japanese Reference No. 54/48,521; U.S. Patents Nos. 4,379,837; 4,444,877; 4,665,012; 4,686,178; 4,565,778; 4,728,602; 4,668,614 and 4,636,461; and in European Reference No. 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surface of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyoanines. Illustrative spectral sensitizing dyes are disclosed in *Research Disclosure*, Item 308119, cited above, Section IV.

Suitable vehicles for the emulsion layers and other layers of elements of this invention are described in *Research Disclosure*, Item 308119, Section IX and the publications cited therein.

In addition to the 2-phenylcarbamoyl-1-naphthol DIR and DIAR couplers described herein, the elements of this invention can include additional couplers as described in *Research Disclosure*, Section VII, paragraphs D, E, F and G and the publications cited therein. These additional couplers can be incorporated as described in *Research Disclosure*, Section VII, paragraph C, and the publications cited therein. The coupler combinations of this invention can be used with colored masking couplers as described in U.S. Pat. No. 4,883,746 or with couplers that release bleach accelerators as described in European Patent Application No. 193,389, both of which are incorporated herein.

The photographic elements of this invention can contain brighteners (*Research Disclosure*, Section V), antifoggants and stabilizers (*Research Disclosure*, Section VI), antistain agents and image dye stabilizers (*Research Disclosure*, Section VII, paragraphs I and J), light absorbing and scattering materials (*Research Disclosure*, Section VIII), hardeners (*Research Disclosure*, Section X), coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI).

The photographic elements can be coated on a variety of supports as described in *Research Disclosure*, Section XVII and the references described therein.

The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride, 4-amino-N-ethyl-N,N-diethylaniline hydrochloride, and 4-amino-N-ethyl-N-(2-methoxyethyl)-m-toluidine di-p-toluenesulfonic acid.

With negative-working silver halide, the processing step described above provides a negative image. The described elements are preferably processed in the known C-41 color process as described in, for example, the *British Journal of Photography Annual*, 1988, pages 196–198. To provide a positive (or reversal) image, the color development step can be preceded by development with a non-chromogenic developing agent to develop exposed silver halide, but not from dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The following examples demonstrate the color photographic materials and methods of the present invention. Throughout the examples and the present specification, parts and percentages are by weight, unless otherwise specified. In the examples, several conventional coupler solvents S1–S5 are also employed and are defined as follows:

S1: Tritolyl Phosphate (mixed isomers)
S2: Dibutyl Phthalate
S3: 1,4-cyclohexylenedimethylene bis-(2-ethylhexanoate)
S4: N,N-diethyldodecanamide
S5: N-butylacetanilide

EXAMPLE 1

In this example, a simple single-layer film test was developed to evaluate the propensity for crystallization of dyes derived from 2-phenylcarbamoyl-1-naphthol couplers in various coupler solvents. For this test, dispersions of the coupler and the coupler Solvent in aqueous gelatin were prepared and coated on transparent supports. The hardened films were immersed in a solution containing 4-amino-3-methyl-β-N-ethyl-N-hydroxyethylaniline sulfate, which is the developer used in the KODAK ® C-41 process, and potassium ferricyanide buffered at a pH of 10. The ferricyanide oxidized the phenylene diamine developer, and the oxidized developer reacted with coupler to form dye. The film samples were then washed and dried, and the dye absorption was measured on a spectrophotometer before and after cold storage.

Individual dispersions of couplers C1, C4 and C7 described above were prepared using various coupler solvents at a 1:2 coupler:coupler solvent weight ratio. An oil phase containing coupler (0.1 g), coupler solvent (0.2 g), and ethyl acetate as an auxiliary solvent (1.6 mL) was dispersed in an aqueous phase containing 20.2 mL of water, 1.0 g of gelatin and 0.1 g of a dispersing agent (ALKANOL XC supplied by Dupont) by passing the mixture through a colloid mill in a manner well known in the art. In formation of the films, the desired coupler laydown was 0.45 g/m$^2$ for C4 and C7 and 0.36 g/m$^2$ for C1. The gelatin laydown was 4.3 g/m$^2$. The ethyl acetate auxiliary solvent evaporated upon coating. Formaldehyde (0.008 g) was added to the dispersions prior to coating to harden the gelatin film.

The hardened films were immersed for two minutes in a borate buffer solution (pH=10) containing 2.2 g/L of 4-amino-β-3-methyl-N-ethyl-N-hydroxyethylaniline sulfate, 0.25 g/L of sodium sulfite, and 12.0 g/L of potassium ferricyanide. The resulting dye-containing films were then immersed in a 2% acetic acid solution for one minute and washed for 5 minutes at 27° C. Spectral densities were then measured with a Sargent-Welch PU8800 spectrophotometer. Film samples had a density of approximately 1.5 at the absorbance maximum near 700 nm. The film samples were then stored in a freezer for 24 hours at −2° C. and the absorption spectra were remeasured. Table I sets forth the losses in density from the original absorbance maximum exhibited by the various film samples after cold storage. As is evident from the comparison in Table I, the density losses exhibited by the coupler and phenolic coupler solvent (P1 or P2) combinations of the invention are substantially less than the density losses exhibited by combinations of couplers C1, C4 and C7 with the conventional coupler solvent S1. The improved resistance to density losses on cold storage was particularly striking in the combinations of couplers C1 and C4 with phenolic coupler solvents.

TABLE I

| Coupler | Coupler Solvent | Density Loss at Absorption Maximum |
|---|---|---|
| C1 | S1 | 0.37 |
| C1 | P1 | 0.01 |
| C4 | S1 | 0.30 |
| C4 | P1 | 0.03 |
| C4 | P2 | 0.03 |
| C7 | S1 | 0.03 |
| C7 | S2 | 0.14 |
| C7 | P1 | 0.00 |

EXAMPLE 2

This example demonstrates materials containing DIAR couplers, imaging coupler and phenolic coupler solvent exhibiting reduced density and hue changes upon cold storage of processed multilayer films. The multilayer film structure is set forth in Table II. The various dispersions were prepared and coated in accordance with methods known in the art. Laydowns, in $g/m^2$ are indicated in the film structure, wherein solid lines mark the boundaries between layers, while dashed lines differentiate between separate coating melts in a given layer that are mixed immediately prior to coating.

TABLE II

MULTILAYER FILM STRUCTURE

| Layer | Description | Composition |
|---|---|---|
| 1. | Protective Overcoat: | Polyvinyltoluene Matte Beads (0.038) in Gelatin (0.888) |
| 2. | UV Absorbing Layer: | Silver Halide (0.215 Ag)<br>Lippmann Emulsion<br>B1 (0.108) + S3 (0.108)<br>B2 (0.108) + S3 (0.108)<br>Gelatin (0.538) |
| 3. | Fast Yellow Layer: | B3 (0.161) + S2 (0.081)<br>B4 (0.054) + S2 (0.054)<br>B5 (0.003) + S4 (0.003)<br>Silver Bromoiodide Emulsion (0.430 Ag)<br>3% Iodide T-grain (1.10 × 0.12 μm)<br>Gelatin (0.791) |
| 4. | Slow Yellow Layer: | B3 (1.022) + S2 (0.511)<br>B4 (0.168) + S2 (0.168)<br>Silver Bromoiodide Emulsion (0.274 Ag)<br>3% Iodide T-grain (0.57 × 0.12 μm)<br>Silver Bromoiodide Emulsion (0.118 Ag)<br>3% Iodide T-Grain (0.52 × 0.09 μm)<br>Gelatin (1.732) |
| 5. | Interlayer: | Carey-Lea Silver (0.043)<br>B6 (0.054) + S4 (0.027)<br>Gelatin (0.861)<br>Palladium Antifoggant |
| 6. | Fast Magenta Layer | B7 (0.258) + S1 (0.258)<br>B8 (0.054) + S1 (0.108)<br>Silver Bromoiodide Emulsion (0.538 Ag)<br>3% Iodide T-grain (1.05 × 0.12 μm)<br>Silver Bromoiodide Emulsion (0.753 Ag)<br>3% Iodide T-Grain (0.75 × 0.14 μm)<br>Gelatin (1.119) |
| 7. | Slow Magenta Layer: | B7 (0.161) + S1 (0.161)<br>B9 (0.108) + S1 (0.215)<br>Silver Bromoiodide Emulsion (0.473 Ag)<br>3% Iodide T-Grain (0.55 × 0.08 μm)<br>Silver Bromoiodide Emulsion (0.495 Ag)<br>3% Iodide T-Grain (0.52 × 0.09 μm)<br>Gelatin (2.916) |
| 8. | Interlayer: | B6 (0.054) + S4 (0.027)<br>Gelatin (1.291)<br>Palladium Antifoggant |
| 9. | Fast Cyan Layer: | TABLE III |
| 10. | Slow Cyan Layer: | TABLE IV |
| 11. | Anti-Halation Layer: | Grey Silver (0.323)<br>B10 (0.025) + S1 (0.050)<br>B11 (0.129) + S3 (0.258)<br>B12 (0.090)<br>B13 (0.008) + S2 (0.038)<br>B6 (0.108) + S3 (0.054)<br>Gelatin (2.690) |
| 12. | Cellulose Acetate Support | |

With reference to Table II, B1–B13 are as follows:

B1: Ultraviolet absorbing compound 1.
B2: Ultraviolet absorbing compound 2.
B3: Yellow coupler.
B4: Yellow DIAR coupler.
B5: Blend accelerator releasing coupler.
B6: Interlayer scavanger.
B7: Magenta coupler.
B8: Magenta DIR coupler.
B9: Magenta masking coupler.
B10: Orange dye.
B11: Magenta dye.
B12: Yellow dye.
B13: Cyan dye.

The B10–B13 dyes were used for antihalation and for printing purposes.

In evaluating the advantages of the photographic materials of the present invention, the fast and slow cyan dye-forming layers 9 and 10, and particularly the fast cyan dye-forming layer 9 are most relevant, and the compositions of these layers are set forth in Tables III and IV, respectively.

TABLE III

FAST CYAN LAYER 9

2A: C4 (0.102) + A1 (0.102) + S1 (0.408) Codispersion
2B: C4 (0.102) + A1 (0.102) + S2 (0.408) Codispersion
2C: C4 (0.102) + A1 (0.102) + S2 (0.408) Codispersion
plus C1 (0.065) + S1 (0.258)
Silver Bromoiodide Emulsion (0.807 Ag)
6% Iodide T-grain (K1882 1.40 × 0.12 μm)
Gelatin (1.506)

TABLE IV

SLOW CYAN LAYER 10

A1 (0.689) + S2 (0.344)
Gelatin (0.925)
C4 (0.030) + A1 (0.030) + S1 (0.118) Codispersion
A1 (0.089) + S2 (0.044)
B3 (0.006) + S4 (0.006)
Silver Bromoiodide Emulsion (1.130 Ag)
3% Iodide T-grain (K1887 0.75 × 0.14 μm)
Gelatin (1.130)
C4 (0.035) + A1 (0.035) + S1 (0.140) Codispersion
A1 (0.105) + S2 (0.052)
B5 (0.005) + S4 (0.005)
Silver Bromoiodide Emulsion (1.345 Ag)
1.5% Iodide Cubic (K1890 0.31 μm)(1)
or (XK1891 0.37 μm)(2)
Gelatin (1.237)

With respect to Tables II and IV, the bleach accelerator releasign coupler B5 is of the formula:

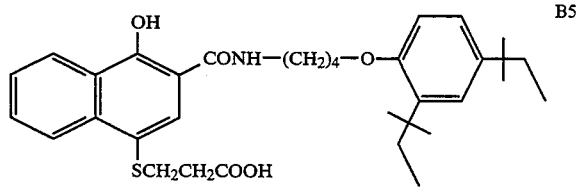

B5

As indicated in Table III, two different cubic silver bromoiodide emulsions, namely (1) K1890 and (2) XK1891, were alternately included in the slow cyan layer. However, as will be indicated in Table V below, this did not have any effect on the observed density losses of processed films resulting from cold storage.

Dispersion 2A for the fast cyan layer 9 was prepared as follows. An oil phase containing a mixture of two parts of coupler C4, two parts of coupler A1, and eight parts of coupler solvent S1 was added to an aqeuous phase containing 10% gelatin and 0.3% of the surfactant ALKANOL XC. This two phase solution was premixed at 50° C. for 2.5 min at 5000 RPM in a Silverson rotor-stator mixer. The mixture was then passed through a Crepaco homogenizer at 5000 psi. The resulting dispersion contained 2% C4, 2% A1 and 8% S1, by weight. Dispersions 2B and 2C for the fast cyan layer 9 were prepared similarly, except that 2B and 2C each contained 8% S2 as coupler solvent. Dispersion 2D contained 4% S2 and 4% P1 as coupler solvents. The slow cyan emulsions employed with dispersions 2A and 2B contained silver bromoiodide emulsion K1890 while the slow cyan emulsions employed with dispersions 2C and 2D contained silver bromoiodide emulsion.

After hardening, the resulting multilayer film samples were exposed and processed in a standard C-41 color negative process. Status M red densities versus exposure were measured for processed neutral exposures, both before and after cold storage for 7 days at −14° C. The resulting red density losses are provided in Table V.

TABLE V

| Fast Cyan Dispersion | Slow Cyan Emulsion | Status M Red Density Loss at Step 9 (Density ≈ 1.1) after 7 days at −14° |
|---|---|---|
| 2A: C4:A1:S1 (1:1:4) (Comparative example) | K1890 | 0.051 |
| 2B: C4:A1:S2 (1:1:4) (Comparative example) | K1890 | 0.113 |
| 2C: C4:A1:S2 (1:1:4) (Comparative example) | XK1891 | 0.115 |
| 2D: C4:A1:S2:P1 (1:1:2:2) (Invention) | XK1891 | 0.016 |

From the data in Table V it is evident that use of either S1 or S2 alone as coupler solvents for the C4–A1 codispersion leads to substantial losses in red density on cold storage. The density losses with S2 are essentially independent of emulsion changes in the slow cyan layer, as shown by the similar density loss values for 2B and 2C. It is also evident from the data in Table V that the use of the phenolic coupler solvent P1 of this invention together with S2 in the codispersion of DIAR coupler C4 and imaging coupler A1 (2D) leads to a substantial reduction in red density loss on cold storage relative to the density losses obtained for the comparative examples which did not employ the phenolic coupler solvent P1.

EXAMPLE 3

In this example, multi-layer coatings similar to those of Example 2 were prepared except that separate dispersions of C4 and A1 were used as set forth in Table VI, rather than codispersions of C4 and A1 as employed in Example 2. The cubic bromoiodide emulsion XK1891 described in Example 2 was employed in the slow cyan layer 10 for all of the films of this example.

TABLE VI

| FAST CYAN LAYER 9 |
|---|
| 3A & 3D: C4 (0.102) + S5 (0.408) |
| 3B: C4 (0.102) + S2 (0.264) + P1 (0.204) |
| 3C: C4 (0.102) + P1 (0.408) |
| plus 3A, 3B & 3C: C1 (0.065) + S1 (0.258) |
| 3D: C1 (0.065) + P1 (0.258) |
| plus A1 (0.102) + S2 (0.051) |
| Silver Bromoiodide Emulsion (0.807 Ag) |
| 6% Iodide T-Grain (K1882 1.40 × 0.12 μm) |
| Gelatin (1.506) |

As in Example 2, the hardened films of this example were given a neutral exposure and processed using the standard C-41 color negative process. Status M red densities were measured, after which the films were stored for 7 days at −14° C. The losses in status M red density after cold storage for the various films of this example are listed in Table VII.

TABLE VII

| Fast Cyan Dispersion | Status M Red Density Loss at Step 9 (Density ≈ 1.1) after 7 days at −14° |
|---|---|
| 3A: C4:S5 (1:4); C1:S1 (1:4) (Comparative example) | 0.162 |
| 3B: C4:S2:P1 (1:2:2); C1:S1 (1:4) (This invention) | 0.019 |
| 3C: C4:P1 (1:4); C1:S1 (1:4) (This invention) | 0.004 |
| 3D: C4:S5 (1:4); C1:P1 (1:4) (This invention) | 0.024 |

The density losses in the films containing C4 in P1 (3B and 3C) are much lower than that of 3A, which contained C4 dispersed with the conventional coupler solvent S5. Moreover, when DIR coupler C1 was dispersed with P1 of the present invention (3D), the density loss on cold storage was very low, even when C4 was dispersed in S5. It is believed that this is a result of mixing of the P1 from the C1 dispersion with the C4 dispersion during the coating process.

EXAMPLE 4

Figure 1B:
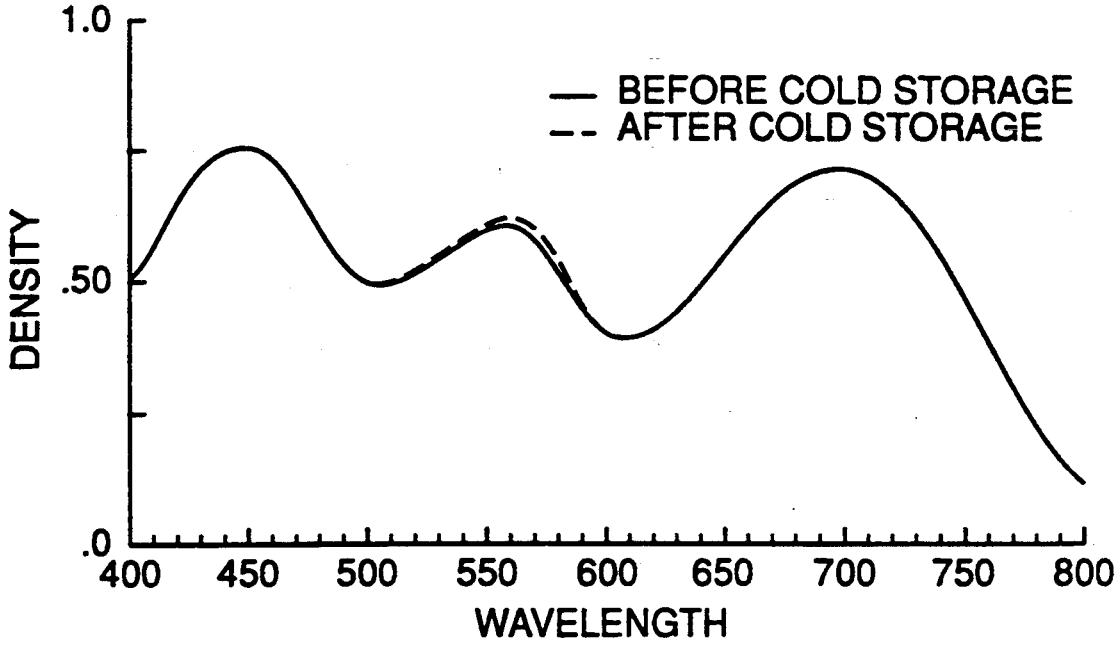

In this example, multilayer coatings similar to those of Example 2 were prepared, except that in the fast cyan layer 9, the DIR coupler C1 (0.065) was codispersed with both imaging coupler A1 (0.065) and coupler solvent S1 (0.258). Additionally, in Example 4A, DIAR C4 (0.102) was codispersed with A1 (0.102) and the coupler solvent S1 (0.408). In Example 4B, C4 (0.102) was codispersed with A1 (0.102) and a mixture of coupler solvents S2 (0.204) and P1 (0.204). Hardened film samples were exposed and processed as in Example 2. Absorption spectra of processed neutral exposures having densities of approximately 0.7 above Dmin were measured on a Seargent-Welch PU8800 spectrophotometer before and after cold storage for 60 hours at −18° C. Spectra were measured versus a Dmin reference, wherein Dmin refers to the density of the processed film samples with no exposure. Spectra obtained from the comparative example, 4A, containing no P1, and the example of this invention, 4B, containing P1 are set forth in FIGS. 1A and 1B, respectively. It is evident that the photographic material 4B of this invention exhibits less spectral change and a much lower loss in red density after cold storage.

The preceding examples are set forth to illustrate specific embodiments of this invention and are not intended to limit the scope of the materials or methods of the invention. Additional embodiments and advantages within the scope of the claimed invention will be apparent to one of ordinary skill in the art.

What is claimed is:

1. A color photographic material, comprising a substrate bearing a silver halide emulsion and a coupler composition comprising in combination (a) a 2-phenylcarbamoyl-1-naphthol compound selected from the group consisting of development inhibitor releasing couplers and timed development inhibiting releasing couplers, and (b) a phenolic coupler solvent.

2. A color photographic material as defined by claim 1, wherein the 2-phenylcarbamoyl-1-naphthol compound is a development inhibitor releasing coupler of the following formula I:

FORMULA I

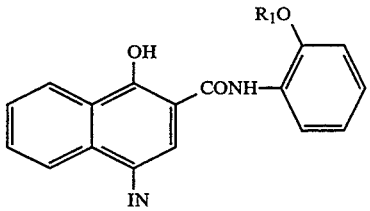

wherein $R_1$ is selected form the group consisting of unsubstituted straight chain alkyl groups containing from about 8 to about 20 carbon atoms and substituted alkyl groups containing from about 10 to about 30 carbon atoms, the substituents being selected from the group consisting of phenyl, alkoxy, aryloxy and alkoxycarbonyl groups; and IN is an inhibitor moiety.

3. A color photographic material as defined by claim 2, wherein $R_1$ is an unsubstituted straight chain alkyl group.

4. A color photographic material as defined by claim 2, wherein the inhibitor moiety is selected from the following formulas IV–VIII:

FORMULA IV

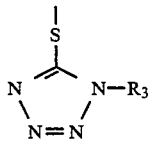

FORMULA V

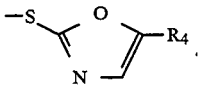

FORMULA VI

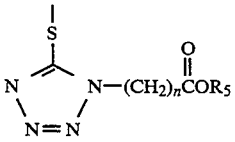

FORMULA VII

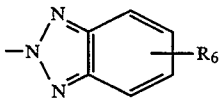

FORMULA VIII

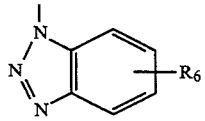

wherein $R_3$ is selected from the group consisting of unsubstituted straight and branched chain alkyl groups containing from 1 to about 8 carbon atoms, an unsubstituted benzyl group, an unsubstituted phenyl group, and said groups containing at least one alkoxy substituent; $R_4$ is selected from the group consisting of $R_3$ and —S—$R_3$; $R_5$ is selected from the group consisting of straight and branched chain alkyl groups containing from 1 to about 5 carbon atoms; $R_6$ is selected from the group consisting of hydrogen, halogen, alkoxy, phenyl, —$COOR_7$ and $NHCOOR_7$ wherein $R_7$ is selected from the group consisting of alkyl and phenyl groups; and n is from 1 to 3.

5. A color photographic material as defined by claim 4, wherein IN is of the formula IV and $R_3$ is selected from the group consisting of ethyl and phenyl.

6. A color photographic material as defined by claim 1, wherein the 2-phenylcarbamoyl-1-naphthol compound is a timed development inhibiting releasing coupler selected from the following formulas II and III:

FORMULA II

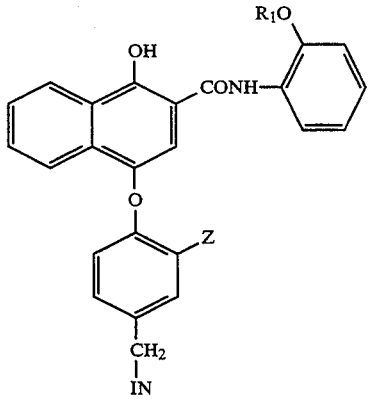

FORMULA III

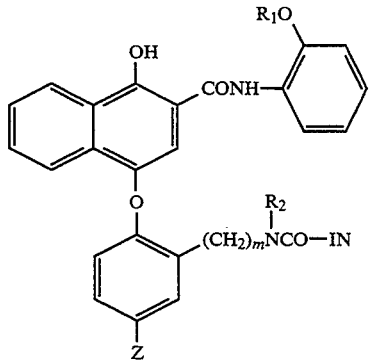

wherein $R_1$ is selected form the group consisting of unsubstituted straight chain alkyl groups containing from about 8 to about 20 carbon atoms and substituted alkyl groups containing from about 10 to about 30 carbon atoms, the substituents being selected from the group consisting of phenyl, alkoxy, aryloxy and alkoxycarbonyl groups; $R_2$ is selected from the group consisting of straight and branched chain alkyl groups containing from 1 to about 8 carbon atoms, unsubstituted phenyl, and phenyl substituted with at least one group selected from the group consisting of alkyl and alkoxy groups; Z is selected from the group consisting of nitro, cyano, alkylsulfonyl, sulfamoyl and sulfonamido groups; IN is an inhibitor moiety; and m is 0 or 1.

7. A color photographic material as defined by claim 6, wherein the inhibitor moiety is selected from the following formulas IV–VIII:

FORMULA IV

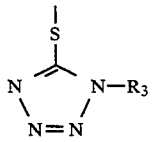

FORMULA V

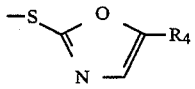

-continued

FORMULA VI

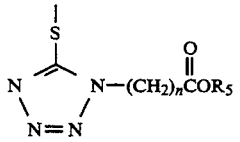

FORMULA VII

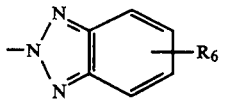

FORMULA VIII

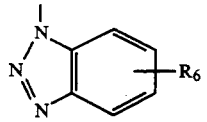

wherein $R_3$ is selected from the group consisting of unsubstituted straight and branched chain alkyl groups containing from 1 to about 8 carbon atoms, an unsubstituted benzyl group, an unsubstituted phenyl group, and said groups containing at least one alkoxy substituent; $R_4$ is selected from the group consisting of $R_3$ and —S—$R_3$; $R_5$ is selected from the group consisting of straight and branched chain alkyl groups containing from 1 to about 5 carbon atoms; $R_6$ is selected from the group consisting of hydrogen, halogen, alkoxy, phenyl, —$COOR_7$ and $NHCOOR_7$, wherein $R_7$ is selected from the group consisting of alkyl and phenyl groups; and n is from 1 to 3.

8. A color photographic material as defined by claim 7, wherein the 2-phenylcarbamoyl-1-naphthol compound is a timed development inhibiting releasing coupler of the formula II.

9. A color photographic material as defined by claim 8, wherein $R_1$ is an unsubstituted straight chain alkyl group, Z is a nitro group, and IN is of the formula IV and $R_3$ selected from the group consisting of p-methoxybenzyl and unsubstituted phenyl groups.

10. A color photographic material as defined by claim 1, wherein the phenolic coupler solvent is of the following formula IX:

FORMULA IX

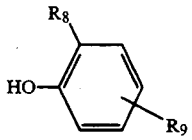

wherein $R_8$ and $R_9$ are individually selected from the group consisting of hydrogen and straight and branched chain alkyl groups, with the provision that at least one of $R_8$ and $R_9$ is not hydrogen, the total number of carbon atoms in $R_8$ and $R_9$ is at least about 9, and $R_9$ is in a para or meta position with respect to the phenolic hydroxyl group.

11. A color photographic material as defined by claim 10, wherein the total number of carbon atoms in $R_8$ and $R_9$ is from 9 to about 20.

12. A color photographic material as defined by claim 10, wherein $R_8$ is hydrogen and $R_9$ is in the para position with respect to the phenolic hydroxyl group.

13. A color photographic material as defined by claim 10, wherein the phenolic coupler solvent comprises p-dodecylphenol.

14. A color photographic material as defined by claim 1, wherein the 2-phenylcarbamoyl-1-naphthol compound and the phenolic coupler solvent are employed in a weight ratio of from about 1:0.2 to about 1:5.

15. A color photographic material as defined by claim 14, wherein the 2-phenylcarbamoyl-1-naphthol compound and the phenolic coupler solvent are employed in a weight ratio of from about 1:0.5 to about 1:4.

16. A color photographic material as defined by claim 1, wherein the coupler composition further includes an additional coupler solvent.

17. A color photographic material as defined by claim 16, wherein the additional coupler solvent comprises dibutylphthalate.

18. A color photographic material as defined by claim 1, wherein the coupler composition further includes a 2-phenylureido-5-carbonamidophenol imaging coupler.

19. A color photographic material as defined by claim 18, wherein the 2-phenylureido-5-carbonamidophenol imaging coupler is of the following formula X:

FORMULA X

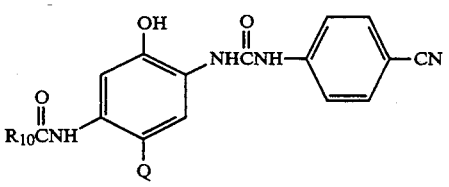

wherein $R_{10}$ is a ballast group containing from about 12 to about 25 carbon atoms; and Q is selected from the group consisting of hydrogen, an unsubstituted phenoxy coupling off group, and,substituted phenoxy coupling off groups wherein the phenoxy moiety is substituted with one or more substituents selected from the group consisting of alkyl groups of from 1 to about 8 carbon atoms and alkoxy groups of from 1 to about 8 carbon atoms.

20. A color photographic material as defined by claim 19, wherein $R_{10}$ is selected from the group consisting of unsubstituted straight and branched chain alkyl groups, unsubstituted straight and branched chain alkenyl groups and unsubstituted straight and branched chain alkylene groups; substituted straight and branched chain alkyl groups, substituted straight and branched chain alkenyl groups, substituted straight and branched chain alkylene groups, and substituted phenyl groups wherein the substituent is at least one member selected from the group consisting of aryl, alkoxy, aryloxy, alkoxycarbonyl, aryloxycarbonyl, acyloxy, carbonamido, carbamoyl, sulfonyl and sulfoxyl groups.

21. A method for reducing dye crystallization and hue changes during cold storage of a color photographic material comprising a substrate bearing a silver halide emulsion and a coupler composition comprising a 2-phenylcarbamoyl-1-naphthol compound selected from the group consisting of development inhibitor releasing couplers and timed development inhibiting releasing couplers, said method comprising adding a phenolic coupler solvent to the coupler composition comprising the 2-phenylcarbamoyl-1-naphthol compound.

* * * * *

UNITED STATES PATENT AND TRADEMARK OFFICE

CERTIFICATE OF CORRECTION

PATENT NO. : 5,451,496

DATED : September 19,1995

INVENTOR(S) : Merkel et al.

It is certified that error appears in the above-indentified patent and that said Letters Patent is hereby corrected as shown below:

Column 16, Table III, after "2C: ... Codispersion" please add -- 2D: C4 (0.102) + A1 (0.102) + S2 (0.204) + P1 (0.204) --.

Column 17, line 8, after "emulsion" add -- K1891 --.

Column 18, claim 1, line 2, after "bearing a" insert --red-sensitive layer comprising (a) a--.

claim 1, line 3, after "(a)" insert --(i)--.

claim 1, line 7, delete "(b)" and insert --(ii)--.

Column 19, claim 2, line 13, after "selected" please delete "form" and insert -- from --.

Column 20, Claim 6, line 40, after "selected" please delete "form" and insert -- from --.

Column 22, claim 16, line 2, delete "coupler composition" and insert --combination of phenylcarbamoyl-1-naphthol compound and phenolic coupler solvent--.

claim 18, line 2, after "the" insert --cyan dye-forming--.

claim 18, line 2, delete "composition further includes" and insert --is--.

UNITED STATES PATENT AND TRADEMARK OFFICE

CERTIFICATE OF CORRECTION

PATENT NO. : 5,451,496
DATED : September 19, 1995
INVENTOR(S) : Merkel et al.

It is certified that error appears in the above-indentified patent and that said Letters Patent is hereby corrected as shown below:

Column 22 claim 21, line 3, after "bearing a" insert --red-sensitive layer comprising (a) a--.

claim 21, lines 3-4, after "emulsion" insert --, (b) a cyan dye-forming coupler,--.

claim 21, line 4, after "and" insert --(c)--.

claim 21, lines 9-10, delete "the coupler composition comprising".

Signed and Sealed this

Eighteenth Day of June, 1996

Bruce Lehman

*Attest:*

BRUCE LEHMAN

*Attesting Officer*

*Commissioner of Patents and Trademarks*